US005580225A

United States Patent [19]

Salecker

[11] Patent Number: 5,580,225

[45] Date of Patent: Dec. 3, 1996

[54] PULSATION CAUSING CHECK VALVE ASSEMBLY FOR A PLURAL PISTON PUMP SYSTEM

[75] Inventor: Roy W. Salecker, Mendota, Ill.

[73] Assignee: Pettibone Corporation, Lisle, Ill.

[21] Appl. No.: 507,952

[22] Filed: Jul. 27, 1995

[51] Int. Cl.[6] ..... F04B 49/03

[52] U.S. Cl. ..... 417/440; 417/442; 137/599.2

[58] Field of Search ..... 417/430, 440, 417/442, 446, 504, 521, 539; 137/599.1, 599.2, 512.1

[56] References Cited

U.S. PATENT DOCUMENTS

| | | | |
|---|---|---|---|
| 3,295,748 | 1/1967 | Leitgeb | 417/440 |
| 3,518,032 | 6/1970 | DeGroff et al. | 417/440 |
| 5,338,160 | 8/1994 | Thurner | 417/446 |

FOREIGN PATENT DOCUMENTS

| | | | |
|---|---|---|---|
| 267377 | 11/1990 | Japan | 417/440 |

*Primary Examiner*—Timothy S. Thorpe
*Assistant Examiner*—Roland G. Andrews, Jr.
*Attorney, Agent, or Firm*—McDermott, Will & Emery

[57] ABSTRACT

The fluid pump has a casing defining an inlet manifold, an outlet manifold and a plurality of piston chambers between the inlet manifold and the outlet manifold, each piston chamber having a piston therein for drawing fluid into the piston chamber from the inlet manifold and for pumping fluid out of the piston chamber into the outlet manifold, and a spring biased check valve associated with each piston chamber wherein a spring biases each valve toward the piston chamber and seals the piston chamber from the outlet manifold, the improvement comprises: at least one of the check valves having a hole therethrough which provides open communication between the outlet manifold and the piston chamber, blocking and sealing structure associated with the check valve for blocking and sealing the opening, and a mechanism for moving the blocking and sealing structure between a first position wherein the hole is blocked and sealed and a second position whereby the hole is not blocked or sealed, such that when the blocking and sealing structure is in the first position, liquid is prevented from flowing from the outlet manifold back into the piston cylinder and thereby causes fluid to exit the pump in a continuous flow and when the blocking and sealing structure is in the second position fluid can flow from the outlet manifold into the piston cylinder and fluid exits the pump in a pulsed or vibratory flow.

7 Claims, 4 Drawing Sheets

PULSATION CAUSING CHECK VALVE ASSEMBLY FOR A PLURAL PISTON PUMP SYSTEM

BACKGROUND OF THE INVENTION

1. Field of the Invention

This invention relates to fluid pumps and, more particularly, to a pump for providing a pulsed delivery of fluid to a point of use.

2. Background Art

High pressure water has long been used to clean blocked and silted drainage, sewer, and other conduits. Water is pumped through a flexible hose at high pressure and is expelled controllably at a downstream nozzle. Jets on the nozzle direct the discharging water angularly with respect to the hose in a trailing direction.

To effect a cleaning operation, the nozzle, which is normally at the leading end of the hose, is introduced to the sewer or other conduit to be cleaned. The water discharging from the jets propels the nozzle and hose forwardly through the conduit. At the same time, the pressurized water scours the walls of the conduit. if excessive or stubborn buildup is present in the conduit, a leading jet may be provided to propel liquid forwardly to break through any obstruction and define a path for the nozzle.

The above technique is employed using different nozzle and hose types, different flow rates and volumes and different pressures, as the particular job dictates. With this technique, it is possible to penetrate and effectively clean conduits up to 400 feet in length. This length is generally the maximum that is encountered for industrial, municipal, and household applications by reason of the regular access afforded through manholes.

While it may be possible to penetrate longer conduits with the above described technique, this technique may not be adequate where curves, elbows, and traps are encountered and/or when the conduit length significantly exceeds 400 feet. To enhance advancement of the nozzle, particularly through a long, circuitous conduit pathway, and break up obstructions, it is known to interrupt the nozzle flow to produce a pulsed fluid delivery through the nozzle by repetitive interruption of high pressure flow through the nozzle. The interruption causes a pulsating action in the nozzle and reduces overall friction between the hose and the conduit wall as the hose advances through a conduit over or around an obstruction because the pulsating action causes the hose to "jump" and thereby break contact between the hose surface and conduit and/or blockage.

A number of systems have been devised to produce pulsed discharge of a fluid. One such system is shown in U.S. Pat. No. 4,838,768, to Flaherty. Flaherty employs two pistons which alternatively operate to discharge fluid through an outlet. Pulses from the separate pistons are timed to immediately follow one another. It is also possible to disable one of the pistons to provide a lag between successive pulses by a single one of the pistons.

Overall, the Flaherty system is relatively complicated and, by reason of requiring custom building, may be relatively expensive. There are five check valves in the system and multiple moving pistons. Failure of any element may result in system malfunction. Another problem with the Flaherty system is that it is inherently quite cumbersome by reason of there being multiple pistons and flow passages associated therewith.

The inventor herein designed a pulsating liquid jet apparatus that is the subject of U.S. Pat No. 5,070,907. This unit has enjoyed ongoing commercial success.

The unit in U.S. Pat. No. 5,070,907, while highly effective, has a number of drawbacks common to systems of similar design. The operation of the unit may be altered when the unit is used to deliver hot water which is commonly done when it is desired to eliminate a frozen blockage in a conduit. The hot water, which is typically at 140°–160° F., effects the function of the springs within the unit which may result in comprised and/or different performance characteristics for the unit.

Another problem with the above unit is that as the unit capacity is increased, the piston must be proportionately increased in size. Accordingly, it may in some situations be necessary to significantly increase the overall size of the unit. It is always the objective of designers of such systems to minimize their size, due to the fact that the units are commonly transported to and around job sites.

Many other systems are currently known for producing a pulsed delivery of a fluid, but these systems likewise have drawbacks which demonstrate the need for an improved fluid pump.

SUMMARY OF THE INVENTION

It is one of the principal objectives of the present invention to provide a pump for producing a pulsating or vibratory action on a hose through which fluid is propelled by the pump, and to make that pump relatively simple in form yet highly reliable and consistent in operation during pumping of both hot and cold fluids.

More particularly, in one form of the invention, a fluid pump is provided having a casing defining an inlet manifold, an outlet manifold and a plurality of piston chambers between the inlet manifold and the outlet manifold. Each piston chamber has a piston therein for drawing fluid into the piston chamber from the inlet manifold and for pumping fluid out of the piston chamber into the outlet manifold. A spring biased check valve associated with each piston chamber is provided wherein a spring biases each check valve toward the piston chamber and seals the piston chamber from the outlet manifold. At least one of the check valves has a hole therethrough which provides open communication between the outlet manifold and the piston chamber. Structure for blocking and sealing the opening is provided in the cylinder and a mechanism for moving the blocking and sealing structure from a first position, where the hole is blocked and sealed, to a second position where the hole is not blocked or sealed.

When the blocking and sealing structure is in the first position, liquid is prevented from flowing from the outlet manifold back into the piston cylinder and thereby causes the pump to operate normally whereby fluid exits the pump in a continuous flow. When the blocking and sealing means is in the second position, fluid can flow from the outlet manifold back into the piston cylinder and thereby causes fluid to exit the pump in a pulsed or vibratory flow.

In one form of the invention the blocking and sealing structure is a shaft which is positioned in the outlet manifold and is threadably coupled to the pump casing. The blocking and sealing structure also includes a plug mounted in the casing and the shaft is threaded into the plug and a cap threaded onto the plug. The shaft can be rotated within the plug by a handle which is attached to the shaft. The shaft is movable relative to the casing to reposition the shaft within the valve opening. This relative movement can be accomplished by threadably connecting the shaft to the plug and casing and rotating the shaft relative to the plug to effect the desired adjustment.

In one form, a cap is provided on the casing, with the plug being in turn connected to the cap and casing for movement relative thereto.

To facilitate repositioning of the shaft relative to the valve, an enlarged knob can be provided on the shaft externally of the casing. The knob can be gripped and turned to rotate the shaft and thereby reposition the shaft relative to the cap/casing.

In one form, the shaft is elongate and is movable relative to the casing in first and second lengthwise directions.

It is another objective of the present invention to allow the pump to be used selectively as a pulsing unit or as a unit to produce a continuous, constant flow volume.

With the inventive structure, existing, continuous flow pumps can be modified to produce a pulse/vibratory discharge simply by replacing one of the valves and replacing the plug. Normally, such pumps have plugs threaded to the ends of the cylinders. By simply removing the plug, the inventive valve and shaft can be retrofit to the pump in the plug opening with only minor modification. The user is afforded the option of using the pump to produce a continuous flow or a pulsed/vibratory flow.

Since the unit does not have to be custom built for pulse/vibratory flow, it can be made relatively inexpensively. The pulsed discharge can be produced without significantly altering the flow volume and flow pressure of the unit. At the same time, no parts are introduced to the existing pump which are heat sensitive. Thus the pump can be used with hot and cold water and will perform consistently with both.

The invention can be practiced with any pump that has at least two operating pistons. More than one piston/cylinder assembly can be modified according to the present invention.

DETAILED DESCRIPTION OF THE DRAWINGS

Figure 1:
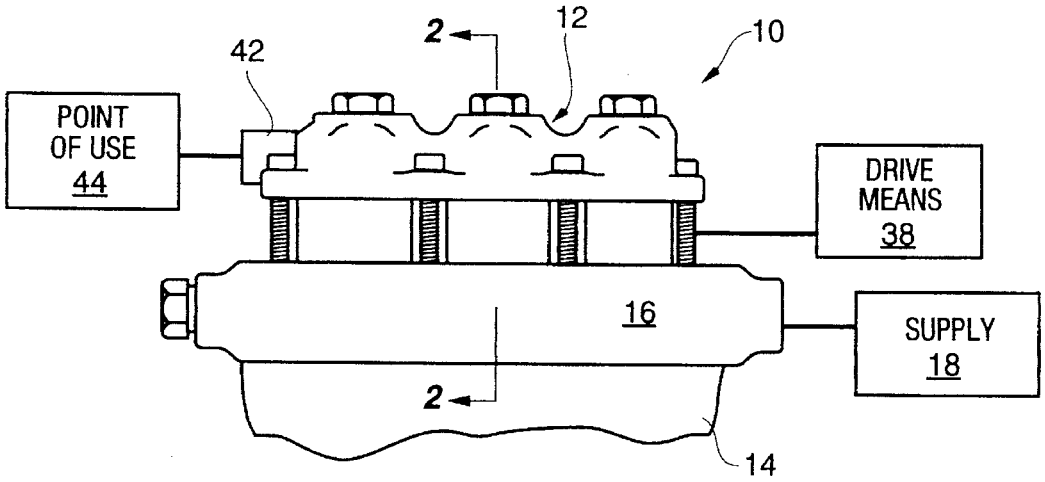
FIG. 1 PRIOR ART
FIG. 1 is a fragmentary side elevation view of a head on a conventional piston-type fluid pump.
Figure 2:
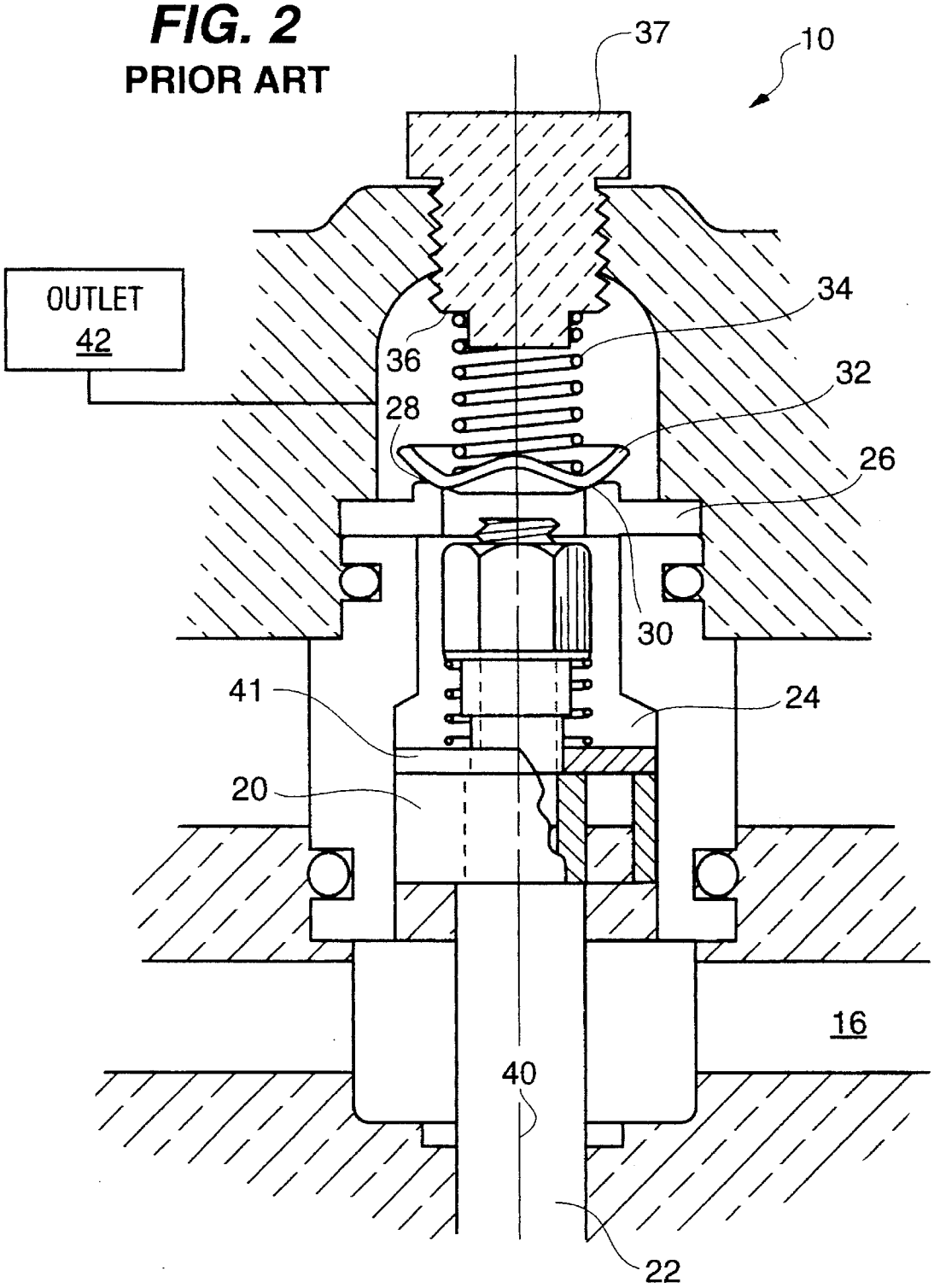
FIG. 2 PRIOR ART
FIG. 2 is an enlarged, cross-sectional view of one of the piston/cylinder assemblies taken along the line 2—2 of FIG. 1.

In FIGS. 1 and 2, a conventional, piston-type fluid pump 10 is shown. The fluid pump 10 is of a conventional construction well known to those skilled in the art. Consequently, a detailed description of the overall pump operation is unnecessary. The particular pump shown is of the type made by Cat Pumps Corporation of Minneapolis, Minn. The description herein will be limited primarily to a pump head 12, with which the present invention is associated.

The pump 10 has a casing 14 defining an inlet manifold 16 for receiving fluid from a supply 18. A plurality of, and in this exemplary unit three, pistons 20 are mounted on rods 22 for reciprocating movement, one each within a cylinder 24.

A seat 26 is defined above the piston 20 and has an annular surface 28 to facially abut a matching surface 30 on a movable valve 32. The valve 32 is normally biased into its seated position, as shown in FIG. 2, by a coil spring 34 which acts between an annular shoulder 36 on a fixed plug 37 that is threaded into the pump head 12, and the valve 32.

As the piston 20 is operated by a drive mechanism 38 and moves downwardly in the direction of the arrow 40, a suction force is developed in the cylinder chamber 24 which draws the fluid from the intake manifold 16, into the cylinder 24 through the piston 20 and around a spring-loaded disc 41, which unseats as the piston 20 moves downwardly. Subsequent opposite movement of the piston 20 closes the disc 41 and drives the fluid against the valve 32, which unseats the valve 32 and places it in an open position against the bias of the spring 34, to allow the fluid to be communicated from the cylinder 24 to an outlet 42 and a point of use 44.

The pistons 20 are synchronized so that the fluid is expelled from the outlet 42 at a substantially continuous pressure and volume.

Figure 3:
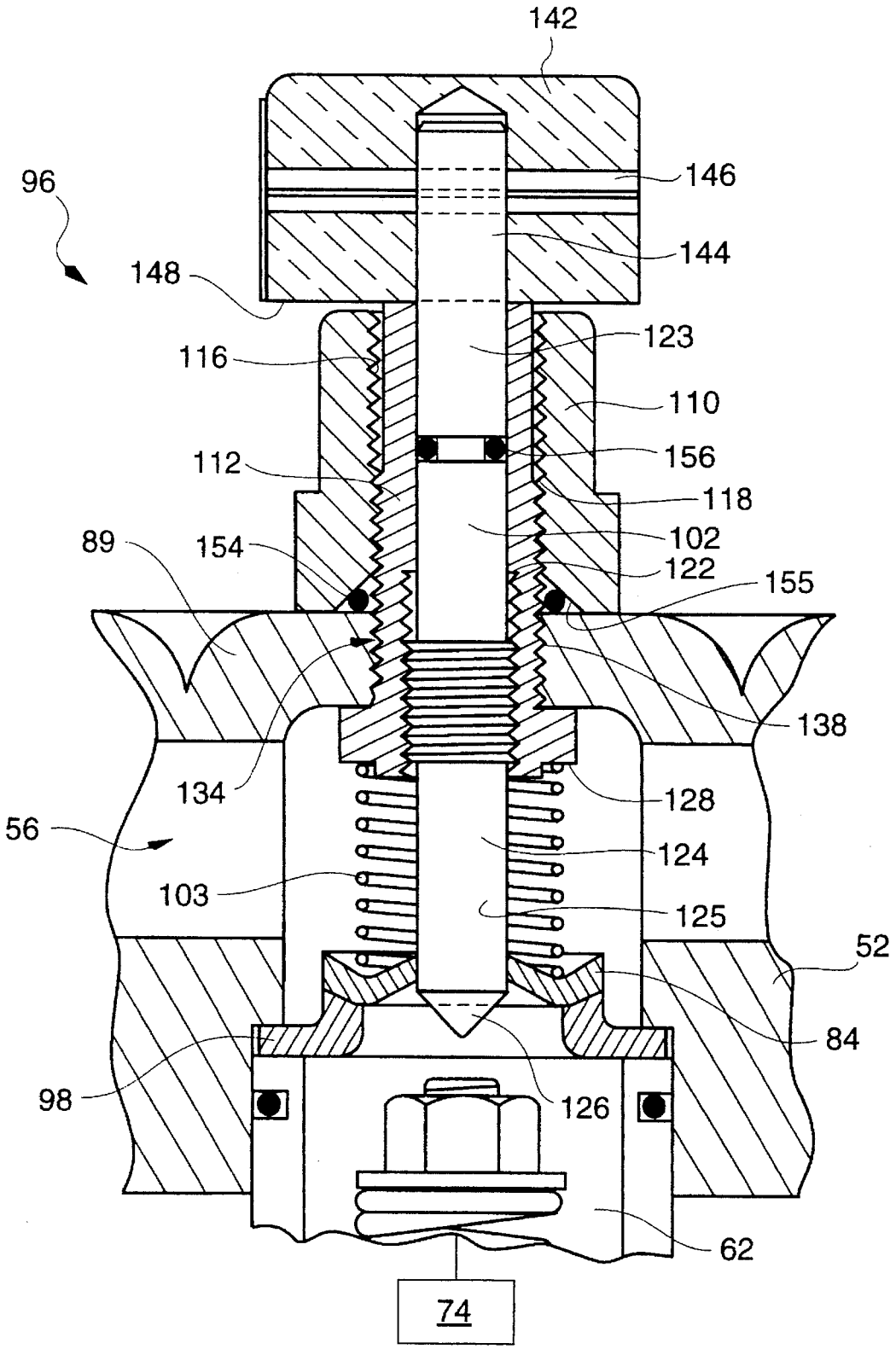
FIG. 3 is a cross-sectional view of a piston/cylinder assembly as in FIG. 2 with the present invention incorporated therein and with the structure set for continuous flow delivery.
Figure 4:
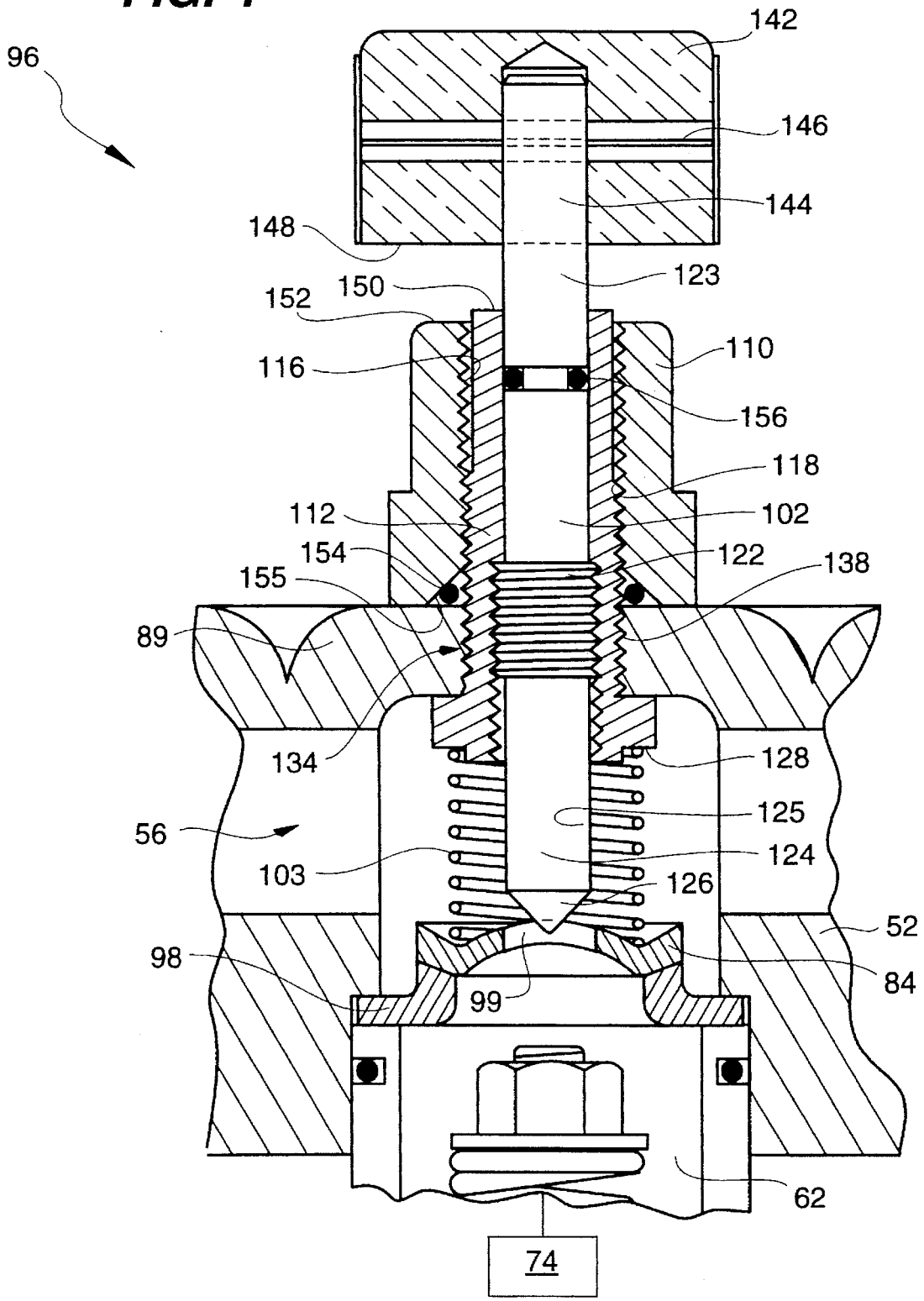
FIG. 4 is a view as in FIG. 3 with the structure set for pulse/vibratory delivery of a fluid.

The present invention contemplates either a modification to an existing piston type pump or custom building of a fluid pump to selectively produce either a steady, high pressure fluid flow from the pump 10 or a pulsed/vibratory discharge of fluid from the pump 10. Details of the invention are shown in FIGS. 3–5.

Figure 5:
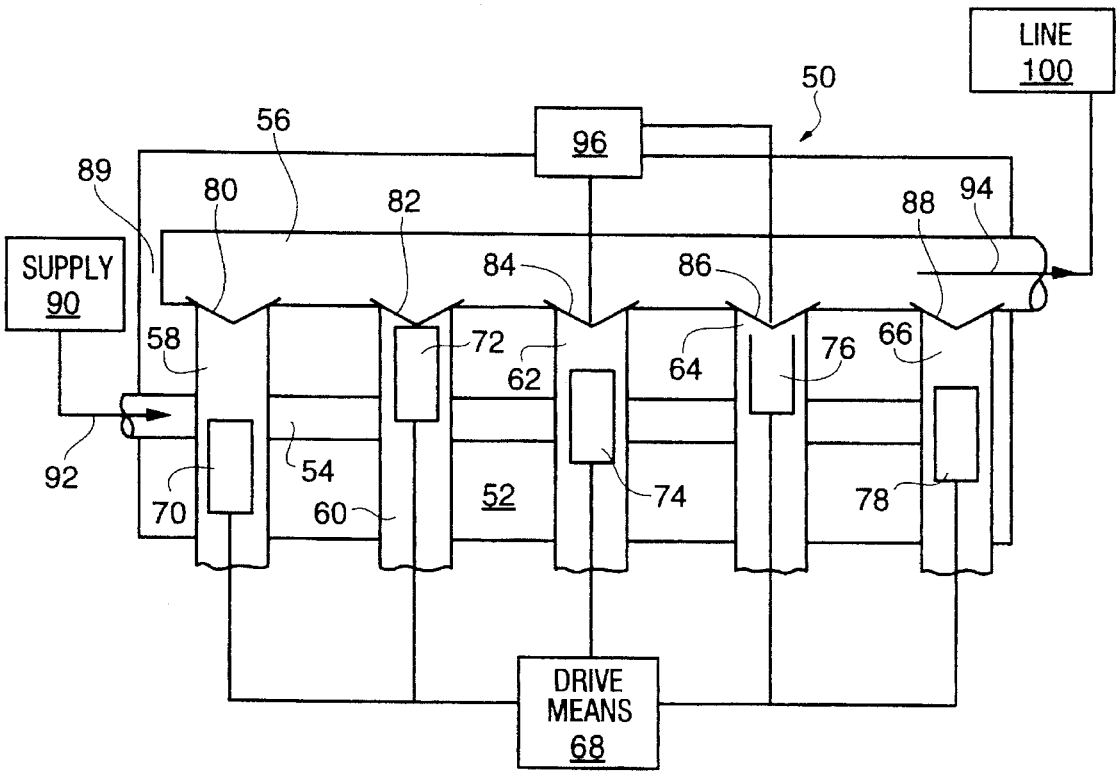
FIG. 5 is a schematic representation of a five piston pump head with the present invention incorporated therein.

In FIG. 5, a fluid-type piston pump, according to the present invention, is shown schematically at 50. The pump 50 has a casing 52 defining an inlet manifold 54, an outlet manifold 56 and five cylinders 58, 60, 62, 64, 66, each in communication with the inlet manifold 54 and outlet manifold 56. A drive mechanism 68 reciprocatively operates pistons 70, 72, 74, 76, 78 within cylinders 58, 60, 62, 64, 66, consecutively. There is a valve 80, 82, 84, 86, 88 associated, one each, with the cylinders 58, 60, 62, 64, 66. The pistons 70, 72, 74, 76, 78 are removable as a unit with a head section 89 that is separable from the remainder of the casing 52.

The pistons 70, 72, 74, 76, 78 are synchronized to normally draw fluid from a supply 90 in the direction of the arrow 92 into the inlet manifold 54 and to discharge the fluid into the outlet manifold 56 for delivery in the direction of the arrow 94 to a point of use.

According to the invention, one or more of the valves 80, 82, 84, 86, 88 is modified. One exemplary valve 84 is shown modified, as shown in FIGS. 3 and 4o More specifically the valve 84 has a central opening 99 therethrough and a device 96 is provided for selectively opening or closing the opening 99 so that the pump 50 can produce either a steady flow or a pulsed/vibratory discharge.

The device 96 includes a shaft 102 that can be adjusted from a first position (FIG. 3) where the opening 99 in the valve 84 is closed to a second position (FIG. 4) where the opening 99 in the valve 84 is open.

With the shaft 102 in the first position, the valve 84 remains in a seated position on a valve seat 98 on top of the cylinder 62 and is biased towards the seat by a spring 103. When the shaft 102 is positioned within the opening 99 the valve 84 operates normally. When operating normally, the valve 84 remains in the seated position when fluid is drawn into the cylinder 62 and when fluid is discharged from the cylinder 62, the valve 84 moves upwardly around the shaft 102 to an unseated position against the bias of the spring 103. Note that there is minimum clearance between the valve 84 and the shaft 102 to form a seal and prevent leakage between the shaft 102 and the valve 84 when the shaft 102 is positioned within the opening 99 in the valve 84.

When the shaft 102 is in its second position, as shown in FIG 4, the shaft 102 is drawn upwardly and allows the cylinder 62 to communicate with the outlet manifold 56 via the opening 99 in the valve 84 when the valve 84 is in its seated position. As a result, as the other pistons 70, 72, 76, 78 are driven upwardly, they discharge fluid into the cylinder 62 through the opening 99 in the valve 84. As a result, there is a momentary pressure loss in the outlet manifold 56 and a prevention of fluid entering cylinder 62 from the inlet manifold 54. As the piston 74 moves upwardly, it discharges the accumulated fluid directed thereinto by the other pistons 70, 72, 76, 78 to increase the pressure of the fluid in the manifold 56. These pressure changes cause a pulsing action in a flexible line 100 communicating with the discharge manifold 56.

A similar device 96 is shown schematically in FIG. 5 on the valve 86. It is preferred, regardless of the number of piston/cylinder assemblies that are provided, that no more than half be equipped with the device 96 placed in an operative state at any one time. The device 96 can be associated with any one or more of the valves 80, 82, 84, 86, 88. The showing of the device 96 on the two valves 84, 86 is made only for purposes of illustration. Note that in a pump having only three cylinders, such a device is preferably attached to one of the cylinders only.

The device 96 can also include a cap 110 which is mounted onto a plug 112. The cap 110 has an axial passage with internal threads 116 which engage external threads 118 on the plug 112. The plug 112 has an axial passage 120 with internal threads 122. The elongate shaft 102 has a top portion 123 and a bottom portion 124 and the shaft 102 is threaded into the axial passage 120 of the plug 112. The bottom portion 124 of the shaft 102 has an outer surface 125 and conical bottom end 126. The bottom portion 124 can extend into the central opening 99 whereby the outer surface 125 of the shaft 102 seals the valve opening 99 as shown in FIG. 3. The valve 84 is confined in movement between a shoulder 128 on the plug 112 and the valve seat 98. The conical bottom end 126 of the shaft helps guide the valve opening 99 around the shaft 102 when the valve 84 moves upwardly during normal operation. Note that when the shaft 102 is drawn upwardly, into its second position, the valve 84 remains seated on the valve seat 98 at all times.

The spring 103 surrounds the shaft 112 and acts between the shoulder 128 on the plug 112 and the valve seat 98. The plug 112 and cap 110 fit in place of the plug 37 which is removed from a pre-drilled threaded bore 134 at the top of the piston head 89 on the casing 52. The external threads 118 of the plug 112 engage threads 138 in the threaded bore 134. The cap 110 is then threaded onto the plug 112 and secures the plug 112 in position on the casing 52.

The shaft 102 is threaded into the plug 112 and a knob 142 is placed over an upper end 144 of the Shaft 102 and maintained in place thereon by a pin 146. The position of the shaft 102 relative to the valve 84 is established by rotating the knob 142, which in turn rotates the shaft 102 to effect lengthwise movement of the shaft 102.

With the device 96 in its operative state, the shaft 102 can be threaded downwardly until a bottom surface 148 of the knob 142 abuts top surfaces 150, 152 of the plug 112 and cap 110, respectively, to position the bottom portion 124 of the shaft 102 within the central opening 99 and to allow the pump 50 to operate in the conventional fashion.

By rotating the knob 142 in the opposite direction, the shaft 102 is drawn upwardly to the position shown in FIG. 4, which represents the operative state for the device 96.

To prevent fluid leakage from the pump 50, an O-ring 154 is placed around the plug 112 and interposed between the cap 110 and casing 52. The cap 110 has a conical wall 155 which forces the O-ring 154 downwardly and inwardly towards the plug 112 and head 89. A separate O-ring 156 surrounds the shaft 102 and seals between the shaft 102 and plug 112.

By removing the fixed plug 37 from a conventional pump, the subassembly consisting of the shaft 102, plug 112, cap 110 and knob 142 can be attached to the casing 52 simply by threading the plug 112 into the casing 52. Then, the cap 110 can be threaded onto the plug 112. Finally, the shaft 102 can be threaded into the plug 112.

It can be seen that an existing pump can be simply retrofit with the device/subassembly to change a conventional pump into one that will produce a pulsing/vibratory action. The device 96 which is used to effect this conversion is relatively simple and inexpensive to construct. At the same time, since the basic mechanism of the pump is only slightly altered, the reliability of the pump is not compromised. In essence, the invention involves converting a conventional pump so as to end up with less moving parts, rather than complicating the structure thereof. There are no seals or heat sensitive springs that would result in any change in function with hot and cold fluid. The pressure loss due to the device 96 is relatively small and can be compensated for through a conventional pressure regulator. Still further, unlike some prior art structure, the pulsing is not caused by flow blockage, which stresses parts, intermittently places a significant load on the electrical system, and detrimentally affects the overall pump operation.

From the foregoing description, it will be apparent that the fluid pump of the present invention has a number of advantages, some of which have been described above and others of which are inherent in the fluid pump of the present invention. Also, it will be understood that modifications can be made to the fluid pump of the present invention without departing from the teachings of the invention. Accordingly the scope of the invention is only to be limited as necessitated by the accompanying claims.

I claim:

1. In a fluid pump having a casing defining an inlet manifold, an outlet manifold and a plurality of piston chambers between the inlet manifold and the outlet manifold, each piston chamber having a piston therein for drawing fluid into the piston chamber from the inlet manifold and for pumping fluid out of the piston chamber into the outlet manifold, and a spring biased check valve element associated with each piston chamber wherein a spring biases each valve element toward the piston chamber and seals the piston chamber from the outlet manifold, the improvement comprising:

at least one of the check valve elements having a hole therethrough which provides open communication between the outlet manifold and the piston chamber;

blocking and sealing means associated with said check valve element for blocking and sealing said opening, said blocking and sealing means including a shaft which is positioned in the outlet manifold and is threadably coupled to the pump casing; and means for moving said blocking and sealing means between a first position wherein said hole is blocked and sealed and a second position whereby said hole is not blocked or sealed, such that when said blocking and sealing means is in said first position, liquid is prevented from flowing from the outlet manifold back into the piston cylinder and thereby causes fluid to exit the pump in a continuous flow and when said blocking and sealing means is in said second position fluid can flow from the outlet manifold into the piston cylinder and fluid exits the pump in a pulsed or vibratory flow.

2. The fluid pump of claim 1 wherein said means for moving the shaft is a handle which is attached to said stem.

3. The fluid pump of claim 1 wherein said blocking and sealing means further includes a plug mounted in the casing and the shaft is threaded into said plug.

4. The fluid pump of claim 3 wherein an O-ring is positioned between said shaft and said plug to prevent leakage of fluid from the pump.

5. The fluid pump of claim 3 wherein said blocking and sealing means further includes a cap threaded onto said plug.

6. The fluid pump of claim 2 wherein an O-ring is positioned between said plug and said cap and adjacent to the casing to prevent leakage of fluid from the pump.

7. The fluid pump of claim 6 wherein said cap has a tapered wall to force said O-ring towards said plug and the casing.

* * * * *